US007290585B2

(12) United States Patent
Takeya et al.

(10) Patent No.: US 7,290,585 B2
(45) Date of Patent: Nov. 6, 2007

(54) METHOD OF COATING LUBRICANT IN METALLIC INJECTION MACHINE

(75) Inventors: Kengo Takeya, Hiroshima (JP); Shinichi Okimoto, Hiroshima (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 11/291,900

(22) Filed: Dec. 2, 2005

(65) Prior Publication Data

US 2006/0118264 A1 Jun. 8, 2006

(30) Foreign Application Priority Data

Dec. 2, 2004 (JP) ..... P2004-349256

(51) Int. Cl.
*B22C 3/00* (2006.01)
*B22D 17/10* (2006.01)
*B22D 27/00* (2006.01)

(52) U.S. Cl. ..... 164/72; 164/113; 164/267; 164/312

(58) Field of Classification Search ..... 164/72, 164/113, 267, 312–318; 264/130; 425/98
See application file for complete search history.

(56) References Cited

U.S. PATENT DOCUMENTS 6,460,596 B1 10/2002 Yamaguchi et al.

FOREIGN PATENT DOCUMENTS

| | | | |
|---|---|---|---|
| JP | 62-127150 | A | 6/1987 |
| JP | 7-323360 | A | 12/1995 |
| JP | 2001-113352 | A | 4/2001 |
| JP | 2002-263815 | A | 9/2002 |
| JP | 2004-167537 | A | 6/2004 |

*Primary Examiner*—Kuang Y. Lin
(74) *Attorney, Agent, or Firm*—Sughrue Mion Pllc.

(57) ABSTRACT

A movable die is fastened to a stationary die, a relationship between a contact force of an injection nozzle to an injection hole of the stationary die and a closeness is investigated, the injection nozzle is brought into press contact with the injection hole of the stationary die by a contact force achieving a predetermined closeness, and a lubricant is coated by a predetermined pressure. At this occasion, one end portion of a cavity is opened or air is exhausted from the end portion as necessary. The lubricant is coated as mist by being mixed with a compressed gas. Further, the lubricant is coated by maintaining constant a pressure difference between a pressure applied to the lubricant and an inner pressure of the cavity and a pressure difference between a pressure of the compressed gas and the inner pressure of the cavity.

16 Claims, 3 Drawing Sheets

METHOD OF COATING LUBRICANT IN METALLIC INJECTION MACHINE

This application is based on Japanese Patent Application No. 2004-349256, which is incorporated herein by reference.

BACKGROUND OF THE INVENTION

1. Field of the Invention

The present invention relates to a method of coating a lubricant in a metallic injection machine which comprises a stationary die and a movable die, and in which a cavity is formed on a side of a parting face of the dies, when the movable side die is fastened to the stationary side die, and a molten metal is injected from an injection nozzle to fill the cavity by way of filling holes of a sprue hole, a runner groove, a gate hole and the like, a metallic mold is provided, and a lubricant is coated on surfaces of the filling holes and a cavity of the die before injecting and filling the molten metal.

2. Description of the Related Art

There is known a thixotropic molding method as one of a molding method for providing a metallic product from a low melting point metallic material of an aluminum alloy, a magnesium alloy, a zinc alloy or the like. According to the method, when an alloy raw material is agitated in a solid/liquid coexistent state, formation of a dendritic crystal, that is, dendrite is restrained, a slurry-like substance brought into a state in which a broken small granular solid and a liquid are coexistent is provided, and the slurry-like substance brought into the solid/liquid coexistent state is injected into a die to solidify to provide a metallic mold having an alloy structure substantially uniformly distributed with the solid. By the method, according to the metallic mold, a shrinkage rate by solidification is small, microshrinkage, that is, a shrinkage hole and a cavity hole by entrapping with a gas is reduced and therefore, an excellent property is shown both in a dimensional accuracy and a mechanical property. An injection molding machine is also used for a method of producing such a metallic mold utilizing the property of the slurry-like substance. The injection molding machine is generally constituted by a heating cylinder, and a screw provided to be able to be driven in a rotational direction and an axial direction at inside of the heating cylinder. A front side of the heating cylinder is attached with an injection nozzle of an open type 'plugged' by a cold plug, or an injection nozzle provided with a shut off valve.

On the other hand, there is known a diecasting method of a hot chamber type as other method of producing a metallic mold. A diecast machine used in embodying the diecasting method is constituted by a stationary die attached to a stationary die disk, a movable die paired with the stationary die, an injection nozzle brought into press contact with the stationary die and the like. The injection nozzle comprises a sleeve, and a plunger provided to be able to be driven in an axial direction at inside of the sleeve. The sleeve is provided with a molten metal supply port. Further, a cavity for molding the metallic mold is formed at a parting line between the stationary die and the movable die. Therefore, when the movable die is fastened to the stationary die, the molten metal in a crucible is supplied into the sleeve by a predetermined amount from the molten metal supply port, the injection nozzle is brought into press contact with the die, and the plunger is driven, the molten metal is injected into the cavity. When the movable die is opened after awaiting for cooling to solidify the injected and filled molten metal, an ejector pin is projected to provide the metallic mold.

In order to provide the metallic mold by injecting the molten metal to fill in the cavity of the molding dies as described above, a lubricant of a liquid or a powder is coated on a surface of the cavity to facilitate to take out the metallic mold from the dies, or to avoid the molten metal from being brought into direct contact with the surface of the cavity. The lubricant is coated by opening the movable die from the stationary die, and directly spraying or coating a water-soluble lubricant constituted by diluting a lubricant solution by water by a spray apparatus. However, according to the principle of the coating method, the water-soluble lubricant is coated and therefore, there are indicated problems of lowering of a die temperature by water, a deterioration in a quality of the mold by scattering the water-soluble lubricant, a deterioration in an operational environment and the like.

Hence, there are proposed coating methods for coating the lubricant in a state of closing the dies. That is, JP-A-62-127150, JP-A-2001-113352 and JP-A-2004-167537 show a method of coating the lubricant by closing the dies and decompressing inside of the cavity, further, JP-A-7-323360 shows a coating method of closing the dies and pressurizing the lubricant into the cavity. Explaining further in details, the lubricant coating method shown in JP-A-62-127150 is applied to diecasting of a cold chamber type, in which the molding dies are closed, inside of the cavity of the dies is brought into a decompressed state by a sucking apparatus, thereafter, the lubricant is coated from a molten metal supply port of an injection sleeve. Further, JP-A-2001-113352 discloses a method of supplying a lubricant by compressed air from a side of a cold plug catcher to a cavity by decompressing inside of a sprue hole, a runner groove, a gate hole, the cavity and the like from the side of the cavity when the lubricant is coated in a die which comprises a stationary side die and a movable die, and in which the sprue hole, the runner groove, the gate hole, the cavity and the like are formed on a side of a parting face of the dies, and which is formed with the cold plug catcher communicated with the sprue hole.

JP-A-2004-167537 shows a diecast machine provided with a projecting pin for projecting a cast product from a die, and a lubricant supply apparatus. The projecting pin of the diecast machine is formed with a supply path for supplying a powder lubricant to a cavity. Further, when the powder lubricant is coated, the projecting pin is projected to shut off a molten steel path and when inside of the cavity is decompressed, the lubricant is coated by being borne on an exhaust air flow. Further, JP-A-7-323360 shows a lubricant coating apparatus of diecasting having an injection sleeve and a lubricant supply apparatus. A molten steel path opening/closing member is provided between the injection sleeve and the lubricant supply apparatus, when the lubricant is coated, a side of the injection sleeve is closed and when the molten steel is injected, the lubricant supply side is closed. Further, the lubricant is injected into the cavity by a pump. When injected, air in the cavity is exhausted by the injected lubricant.

According to the methods of coating the lubricant described in JP-A-62-127150, JP-A-2001-113352, JP-A-2004-167537 and JP-A-7-323360, in any of the coating methods, the lubricant is coated after closing the dies and therefore, the lubricant is not scattered to outside of the dies, the extra lubricant can be recovered by the sucking apparatus or a lubricant exhaust path and therefore, there are achieved advantages of capable of restraining a deterioration in the operational environment and also minimizing a reduction in a mold temperature by coating the lubricant. Particularly, according to the coating method described in JP-A-2001-113352, by decompressing insides of the sprue hole, the runner groove, the gate hole, the cavity and the like from the side of the cavity, the lubricant is coated from a side of a recess portion to the cavity and therefore, it is not necessary to move the injection nozzle at each time of coating the lubricant and therefore, a molding cycle is not prolonged, and the productivity is not deteriorated. Further, it is not necessary to move the injection nozzle at each shot and therefore, an excellent advantage that power cost is not increased is recognized.

However, according to the methods of coating the lubricant of the related arts, problems or points to be improved are also recognized. For examples according to the coating method described in JP-A-62-127150, it is anticipated that when decompressed by the sucking apparatus, in view of the structure of the injection apparatus, outside air invades from the molten metal port or a clearance between sliding faces of the injection plunger and the injection sleeve, and a high decompressing degree is not achieved. As a result, in molding a metallic mold having a thin wall thickness, a metallic having a long total length in a direction of flow of the molten metal, a pressure loss of the lubricant flowing in the cavity is large to bring about a case in which the lubricant cannot be coated sufficiently up to a distal end portion of the cavity. According to the invention described in JP-A-2001-113352, although a number of characteristics are achieved as described above, there is not adopted a significant measure with regard to a contact pressure for pressing the injection nozzle to the stationary die and therefore, there is a concern that a predetermined decompressing degree is not achieved by invasion of outside air when inside of the cavity is decompressed. Further, when the lubricant is supplied by compressed air, the lubricant cannot be supplied by high pressure and therefore, there can be a case in which the lubricant is not sufficiently supplied to corners of a narrow cavity or a cavity having a long flow length.

According to the coating apparatus shown in JP-A-2004-167537, when decompressed, the injection apparatus or the side of the injection nozzle is closed by an extruding pin, that is, a shut off mechanism and opened when the molten metal is injected. Thereby, although a desired vacuum degree is achieved, there pose problems that the die structure becomes complicated, a frequency of maintenance of the shut off mechanism portion is increased, opening/closing operation is needed and a molding cycle is prolonged and the like. According to the coating apparatus disclosed in JP-A-7-323360, the molten metal path opening/closing member is provided between the injection sleeve and the lubricant supply apparatus, when the lubricant is coated, the side of the injection sleeve is closed, when the molten metal is injected, the lubricant supply side is closed and therefore, although a desired vacuum degree is tentatively achieved, since the molten metal path opening/closing member is provided, a problem similar to that of the invention described in JP-A-2004-167537 is posed.

As described above, according to the lubricant coating methods or the die apparatus of the related arts the pressure at inside of the cavity cannot be maintained to the desired pressure and therefore, there is a concern that the metallic mold having the thin wall thickness, the metallic mold having the long total length in the direction of flow of the molten metal and the like cannot be molded. Further, according to the structure having the structure of capable of maintaining the pressure in the cavity to the desired pressure value, the metal path opening/closing member is provided to pose the problems of complicating the die structure, increasing the frequency of maintenance, needing the opening/closing operation, prolonging the molding cycle and the like.

The invention intends to provide a method of coating a lubricant in a metallic injection molding machine resolving the above-described problem or drawback of the related arts, specifically, it is an object of the invention to provide a method of coating a lubricant in a metallic injection molding machine capable of sufficiently coating a lubricant up to a distal end portion of a cavity to provide a metallic mold having a special shape such as a metallic mold having a thin wall thickness, a metallic mold having a long total length in a direction of flow of molten metal or the like. Further, it is an object thereof to provide a method of coating a lubricant in a metallic injection molding machine without particularly needing maintenance and without impairing an injection nozzle or a stationary side die with which the injection nozzle is brought into contact.

SUMMARY OF THE INVENTION

According to the object of the invention, when a movable die is fastened to a stationary die, a parting line face of the dies is substantially hermitically closed. However, there is a possibility that a clearance is produced at a portion of an injection nozzle brought into contact with a sprue hole formed at the stationary die or a locate ring attached to the stationary die. That is, when a contact force or a touch force is small and a closeness is small, outside air invades from the contact portion of the injection nozzle when inside of the cavity is decompressed and when compressed, air escapes therefrom. Therefore, inside of the cavity cannot be maintained to a predetermined pressure and a lubricant cannot be coated sufficiently. Although such leakage can be prevented by increasing the contact pressure, when the contact pressure is excessively large, the injection nozzle or the stationary die with which the injection nozzle is brought into contact is impaired.

The invention achieves the above-described object by constituting the closeness of the injection nozzle to the stationary die to a predetermined value without impairing the injection nozzle or the stationary die with which the injection nozzle is brought into contact.

In this way, in order to achieve the above-described object, a first aspect of the invention provides a method of coating a lubricant in a metallic injection molding machine comprising a die comprising a stationary die and a movable die, a cavity formed on parting faces of at least one of the stationary die and the movable die, a sprue hole, a runner groove, and a gate hole, a molten metal being injected from the injection nozzle via a filling hole of the sprue hole, the runner groove, and the gate hole to fill the cavity for providing a metallic mold, the method comprising fastening the movable die to the stationary die, press contacting an injection nozzle with an injection hole of the stationary die by a contact force to achieve a predetermined closeness based on a relationship between a contact force of the injection nozzle to the injection hole of the stationary die and a closeness thereof, and coating the lubricant to faces of the filling hole and the cavity of the die by a predetermined pressure before injecting the molten metal. According to a second aspect of invention, in the coating, one end portion of the cavity is opened or air is exhausted therefrom, and the lubricant is coated from the other end portion. According to a third aspect of the invention, in the coating, one end portion of the cavity is opened or air is exhausted therefrom, and the lubricant is coated from the other end portion after press contacting, and thereafter, the one end portion of the cavity is closed or air is stopped from being exhausted therefrom, and the lubricant is coated again until an inner pressure of the cavity becomes a predetermined pressure. According to a fourth aspect of the invention, after the coating, an inner pressure of the cavity is decompressed until the inner pressure becomes a predetermined pressure. According to a fifth aspect of the invention, the lubricant is coated as a mist by being mixed with a compressed gas. According to a sixth aspect of the invention, a pressure applied to the lubricant and a pressure of the compressed gas are controlled so as to coat the lubricant while maintaining constant a pressure difference between the pressure applied to the lubricant and an inner pressure of the cavity and a pressure difference between the pressure of the compressed gas and the inner pressure of the cavity.

As described above, according to the first aspect of the invention, there is constructed a structure such that the movable die is fastened to the stationary die, the relationship between the contact force of the injection nozzle to the injection hole of the stationary die and the closeness is investigated, the injection nozzle is brought into press contact with the injection hole of the stationary die by the contact force achieving the predetermined closeness, and the lubricant is coated by the predetermined pressure and therefore, there is achieved an effect particular to the invention such that the lubricant can be coated even to the cavity having a special shape for molding a metallic mold having a thin thickness, a metallic mold having a long total length in a direction of flow of molten metal or the like sufficiently and uniformly without leaking the lubricant to outside or without invasion of outside air. Further, according to the invention, the injection nozzle is brought into contact with the injection hole of the stationary die by a necessary and sufficient contact force and therefore, the injection nozzle or the injection hole of the stationary die is not uselessly impaired. Further, the predetermined closeness is achieved by only bringing the injection nozzle into contact with the injection hole of the stationary die by the predetermined pressure, a closeness mechanism is not particularly needed and therefore, there is also achieved an effect of simplifying the structure of the die for embodying the invention of the method. Further, according to the second or the third aspect of the invention, the injection nozzle is brought into press contact with the injection hole of the stationary die by the contact force achieving the closeness, the one end portion of the cavity is opened or air is exhausted from the end portion, the lubricant is pressurized to be coated from the other end portion and therefore, or the one end portion of the cavity is closed or air from the end portion is stopped to be exhausted after pressurizing to coat the lubricant and the lubricant is pressurized to be coated again until the inner pressure of the cavity becomes the predetermined pressure and therefore, the lubricant can be coated further uniformly and sufficiently at the distal end portion of the cavity. According to the fourth aspect of the invention, there is constructed a structure such that after pressurizing to coat the lubricant, the inner pressure of the cavity is decompressed until the inner pressure becomes the predetermined pressure and therefore, there is also achieved an effect of capable of filling the molten metal to the distal end portion of the narrow cavity or the cavity having the long length of flow. Further, according to the fifth aspect of the invention, the lubricant is coated as the mist and therefore, the lubricant can be coated to the distal end portion of the cavity, according to the sixth aspect of the invention, there is constructed a structure such that by controlling the pressure applied to the lubricant and the pressure of the compressed gas, the lubricant is coated while maintaining constant the pressure difference between the pressure applied to the lubricant and the inner pressure of the cavity and the pressure difference between the pressure of the compressed gas and the inner pressure of the cavity and therefore, in addition to the above-described effects, an effect of stabilizing to coat the lubricant is further achieved.

BRIEF DESCRIPTION OF THE DRAWINGS

FIG. 3 shows drawings showing coating steps using the die used for metallic injection according to the embodiment of the invention.

DETAILED DESCRIPTION OF EXEMPLARY EMBODIMENTS

Metal elements by themselves or alloys on the basis of the metals having melting points equal to or lower than 700° C. are referred to as metal raw materials according to the invention. As actual examples for example, aluminum, magnesium, zinc, tin, lead, bismuth, terbium and the like can be pointed out, and particularly, aluminum, magnesium, lead, zinc, bismuth, tin by themselves and alloys on the basis of metals are preferable. Any of the metal raw materials are metal elements or alloys capable of being melted by heat supplied from outside at inside of a heating cylinder and formed by being injected into a product cavity of a die. Although a melting point of copper is 1085° C. and it is far higher than 700° C., a melting point of a copper alloy, for example, a copper alloy for brazing is equal to or lower than 700° C. and according to the invention, also the copper alloy constitutes an object of the metal raw material. Further, according to the invention, the object of the invention is constituted also by a material molding a metal base composite material by being simultaneously added with a ceramic particle or a ceramic fiber such as $Al_2O_3$, sic.

Figure 1:
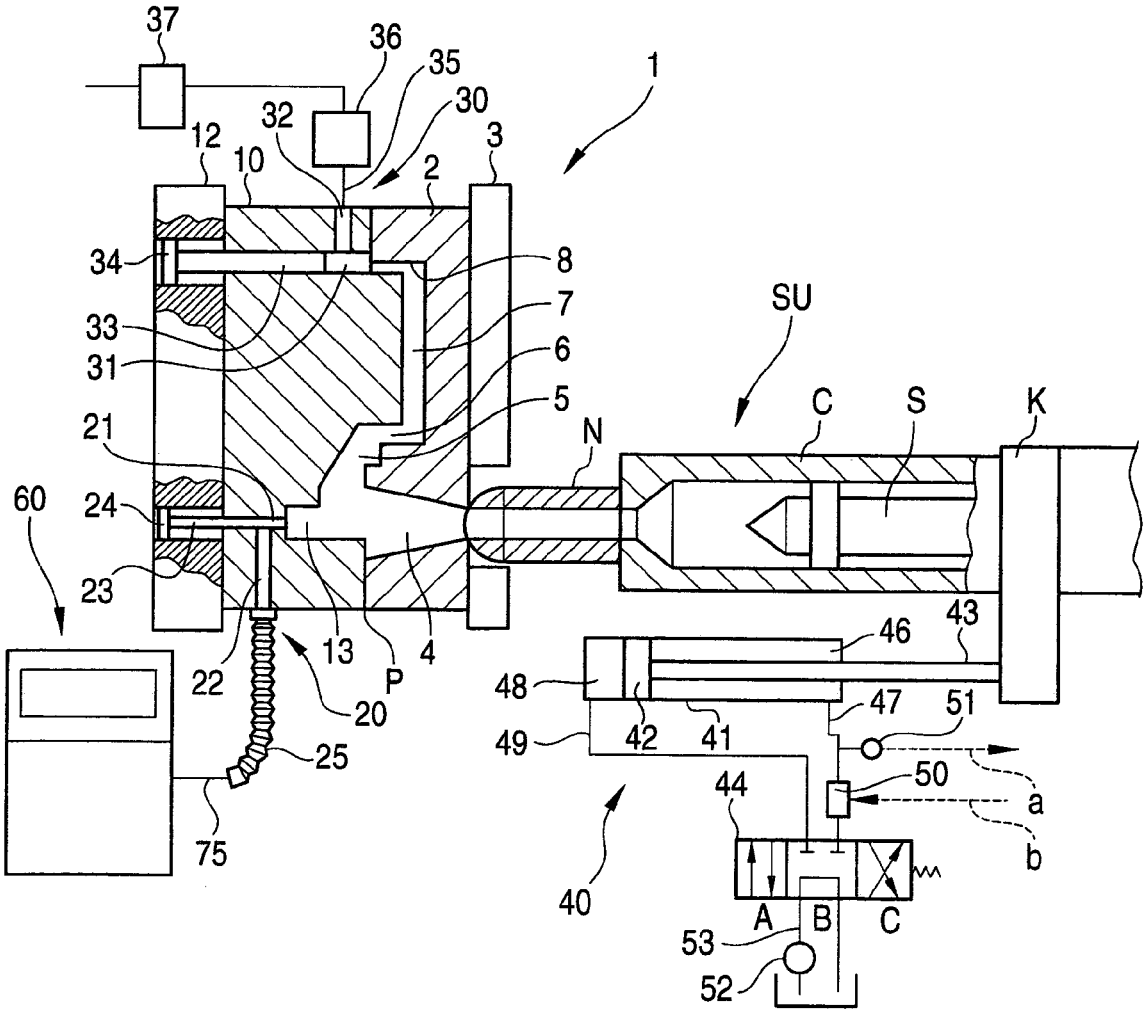
FIG. 1 is a sectional view showing a die used for metallic injection of an embodiment of the invention.

FIG. 1 is a sectional view showing a die 1 used for metallic injection according to an embodiment of the invention in a closed state, as shown by the drawing, the die 1 used for metallic injection according to the embodiment is generally constituted by a stationary die 2 attached to a stationary die disk 3 and a movable die 10 attached to a movable die disk 12 and driven in a direction of opening the die and a direction of closing the die. Further, in the illustrated embodiment, a side of the movable die 10 is provided with a lubricant supply path 20 and an exhaust path 30.

The stationary die 2 is formed with a taper-like sprue hole 4 known in the related art in the form of crossing the stationary die 2. Further, a runner groove 5, a gate hole 6 and a cavity 7 for molding a metallic mold are formed along a parting face P of the stationary die 2 and the movable die 10 to communicate with the sprue 4. Further, an end portion of the cavity 7 on a side opposed to the gate hole 6 is formed with an exhaust hole 8 having a comparatively small volume. An injection unit SU is provided at the sprue hole 4 of the stationary die 2 constituted in this way movably in an axial direction in a state of being able to bring an injection nozzle N of an open type thereof into contact therewith.

As is known in the related art, the injection unit SU is constituted by a heating cylinder C, the injection nozzle N attached to a front side of the heating cylinder C, a screw S provided to be able to be driven in a rotational direction and the axial direction at inside of the heating cylinder C, a drive apparatus for driving the screw S and the like. The injection unit SU constituted in this way is brought into contact with and separated from a start end portion of the sprue hole 4 of the stationary die 2 or a locate ring not shown in FIG. 1 by feeding and discharging a working oil to and from a hydraulic piston/cylinder unit 40. Explaining further in details, the hydraulic piston/cylinder unit 40 comprises a cylinder 41 fixedly provided at a frame or the like, and a piston 42 reciprocally provided at inside of the cylinder 41, and a piston rod 43 is connected to a drive member K of the injection unit SU. A hydraulic circuit for feeding and discharging the working fluid to and from the hydraulic piston/cylinder unit 40 is provided with a direction switching valve 44 of a center block type capable of taking positions A, B and C. An output port of the direction switching valve 44 of the center block type is connected with a first oil path 47 communicated with a piston rod chamber 46 and a second oil path 49 communicated with a piston head member 48. A variable pressure control apparatus 50 is interposed in the first oil path 47, the working oil at a predetermined pressure is supplied to the piston rod chamber 46. Thereby, the injection nozzle N is pressed to the sprue hole 4 by a predetermined pressure to achieve a predetermined closeness. The first oil path 47 is also attached with a pressure sensor 51, and the pressure of the working oil measured by the pressure sensor 51 is inputted to a control apparatus by a signal line a. Further, the variable pressure control apparatus 50 is connected to the control apparatus by a signal line b and a pressure on a delivery side thereof is controlled thereby. Other port of the direction switching valve 44 is connected with a working oil supply path 53 communicated with a hydraulic pump 52.

The movable die 10 having a size substantially the same as that of the stationary die 2 is provided with a cold plug catcher 13 having a predetermined depth and a predetermined size in correspondence with the sprue hole 4 of the stationary die 2 substantially orthogonally to the parting face P. The parting face P of the movable die 10 is formed with a plurality of pieces of recess portions having predetermined sizes and predetermined depths, and the runner groove 5, the gate hole 6, the cavity 7, the exhaust hole 8 and the like are formed by the recess portions and the parting face P of the stationary die 2. Further, a bottom portion of the cavity 7 is opened with a plurality of pieces of through holes in the form of penetrating the bottom portion and the through holes are provided with ejector pins to be able to be projected, although not shown in FIG. 1.

The lubricant supply path 20 formed at the movable die 10 is constituted by a first supply path 21, and a second supply path 22 branched from the first supply path 21 and opened at a side portion of the movable die 10 according to the embodiment. Further, one end portion of the first supply path 21 is opened to a bottom portion of the cold plug catcher 13 and other end portion thereof is opened to a back portion of the movable die 10 on a left side of FIG. 1. The first supply path 21 is provided with a shut off pin 23 driven in an axial direction by the first hydraulic piston/cylinder unit 24. Therefore, in a state in which the shut off pin 23 is driven to a first escape position shown in FIG. 3C, the cold plug catcher 13 and the second supply path 22 are communicated with each other via the first supply path 21 and shut off from each other when the shut off pin 23 is driven to a second position by the first hydraulic piston/cylinder unit 24 such that a front end portion reaches a bottom portion of the cold plug catcher 13. A side portion of the movable die 10 is attached with a connector or the like in correspondence with the second supply path 22 and the connector is connected with a flexible hose 25 via a heat insulating pipe of ceramics or the like. Further, a lubricant supply apparatus 60 is connected to the hose 25.

Also the exhaust path 30 is formed on a side of the movable die 10 and is constituted by a first exhaust path 31 and a second exhaust path 32 branched from the first exhaust path 31 and opened to a side portion of the movable die 10, that is, an upper portion thereof in FIG. 1. One end portion of the first exhaust path 31 is opened to a bottom portion of the exhaust hole 8, and other end portion thereof is opened to a back portion of the movable die 10 on a left side of FIG. 1. The first exhaust path 31 is provided with a shut off pin 33 driven in an axial direction by a second hydraulic piston/cylinder unit 34. Therefore, when the shut off pin 33 is driven to a first escape position shown in FIG. 3C, the exhaust hole 8 and the second exhaust path 32 are communicated with each other via the first exhaust path 31 and shut off from each other when the shut off pin 33 is driven to a second position by the second hydraulic piston/cylinder unit 34 such that a front end portion thereof reaches a bottom portion of the exhaust hole 8. The second exhaust path 32 is connected with a flexible hose 35 by a connector at outside of the movable die 10. The flexible hose 35, or an exhaust pipe connected to the hose 35 is provided with an air sucking apparatus 36 and a mist separator 37 and is opened to the atmosphere.

Figure 2:
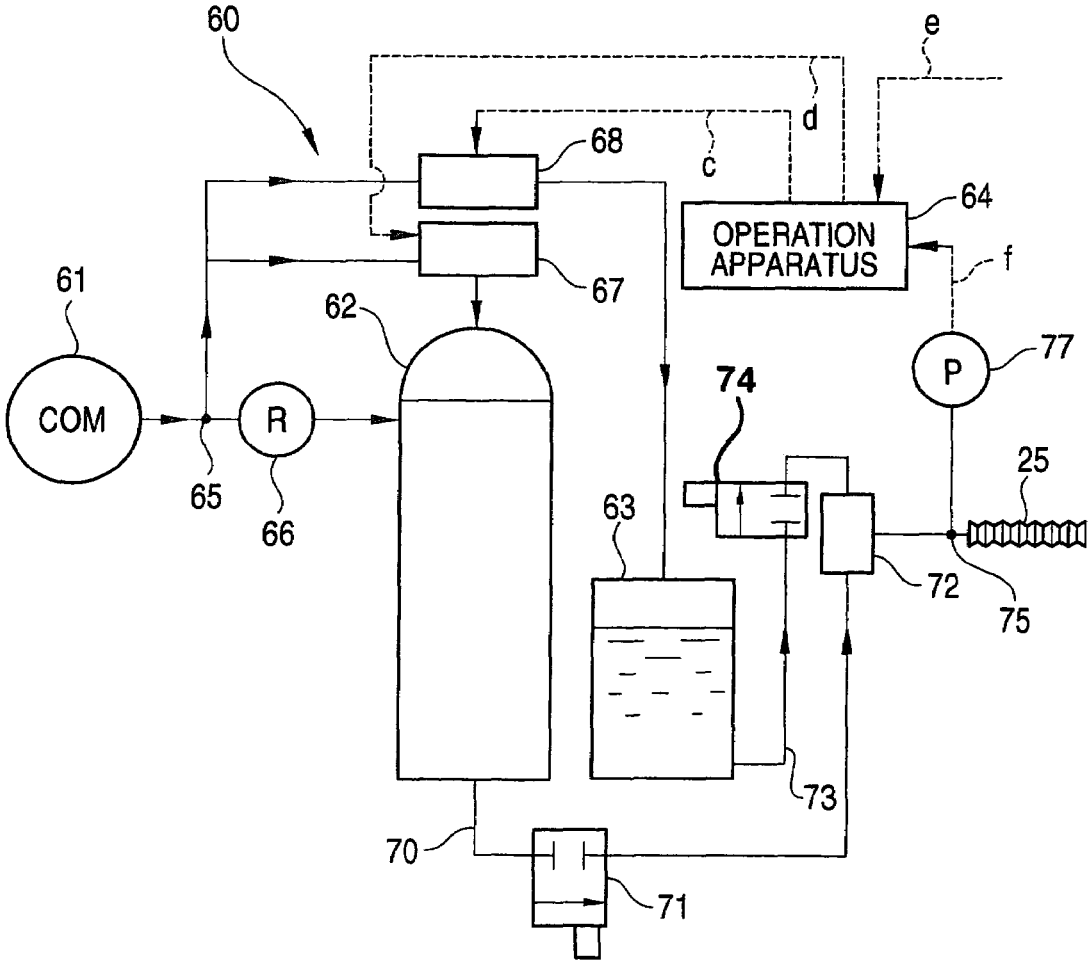
FIG. 2 is a front view schematically showing a lubricant supply apparatus used in the embodiment of the invention.

As shown by FIG. 2, the lubricant supply apparatus 60 is constituted by a compressor 61, a compressed gas tank 62, a lubricant tank 63, an operation apparatus 64 and the like. A compressed gas supply pipe 65 is extended from the compressor 61. The compressed gas supply pipe 65 is interposed with a fixed type pressure control apparatus 66 to be connected to the compressed gas tank 62, and the compressed gas supply pipe 65 is further branched to be respectively connected to top portions of the compressed gas tank 62 and the lubricant tank 63 via variable type pressure control apparatus 67, 68. A gas supply pipe 70, interposed with an electromagnetic opening/closing valve 71, is extended from a lower portion of the compressed gas tank 62 to one input port of a spray nozzle 72 and a lubricant supply pipe 73, similarly interposed with an electromagnetic opening/closing valve 74, is extended from a lower portion of the lubricant tank 63 to another input port of the spray nozzle 72. The spray nozzle 72 is for processing the lubricant in a mist-like form by mixing a gas, for example, air and the lubricant, and an output port of the spray nozzle 72 is connected to the above-described flexible hose 25 via a mist supply path 75.

The operation apparatus 64 and the variable type pressure control apparatus 67, 68 are connected respectively by signal lines d, c, and the variable type pressure control apparatus 67, 68 are controlled based on operation signals from the operation apparatus 64. Thereby, a constant mist flow rate is achieved. Further, although not illustrated in FIGS. 1, 2, the cavity 7 is provided with a pressure sensor, and the pressure at inside of the cavity 7 measured by the pressure sensor is inputted to the operation apparatus 64 by a signal line e. The mist supply path 75 is attached with a pressure sensor 77 and pressure of mist measured by the pressure sensor 77 is inputted to the operation apparatus 64 by a signal line f.

Next, a molding example using the die 1 used for metallic injection according to the above-described embodiment will be explained also in reference to FIG. 3. Further, although the die 1 used for metallic injection according to the embodiment can carry out molding automatically by providing the control apparatus, in order to simplify the following explanation, an example of operating the die mainly manually will be explained.

For example, as a preparatory step, a relationship between a press force or a contact force of the injection nozzle N and a closeness of the cavity 7 is investigated That is, the movable die 10 is fastened to the stationary die 2. The parting face P becomes substantially airtight in view of the structure of the die by the fastening operation. The direction switching valve 44 is made to be disposed at position C and the working oil is supplied to the piston rod chamber 46. Then, the injection unit SU is driven in a left direction of FIG. 1, and the injection nozzle N is pressed or brought into close contact with the sprue hole 4. The press force or the contact force at this occasion is determined by a pressure value of the working oil supplied to the piston rod chamber 46. Compressed air is supplied to the cavity 7, or the cavity 7 is decompressed to provide a relationship between a pressure value when air is leaked and the contact force of the injection nozzle N. The pressure value when air is leaked is provided by pertinently changing the contact force. Thereby, the contact force or the press force when a desired decompressing degree or compressing value is achieved, in other words, the pressure of the working oil supplied to the piston rod chamber 46 can be known. Further, when the relationship between the contact force and the pressure of the working oil as described above is provided, the nozzle hole is closed by a cold plug when the injection nozzle N is constituted by an open type and, the nozzle hole is closed by the valve when a shut off valve is provided.

Figure 3A:
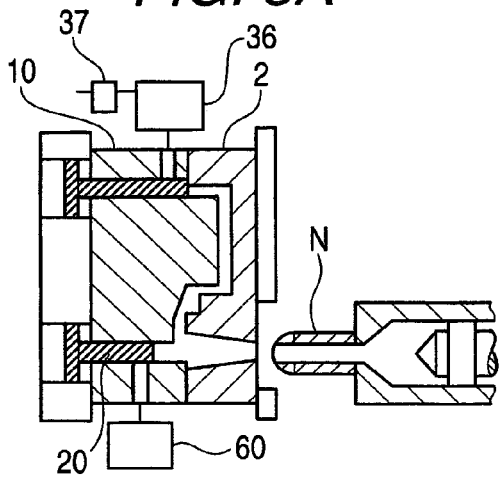
FIG. 3A is a sectional view showing a state of closing a movable die (die closing step)

Although a fastening apparatus is not shown in FIG. 3A, the movable die 10 is fastened to the stationary die 2.

Figure 3B:
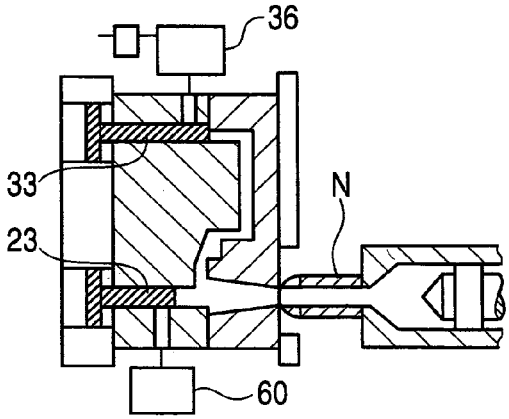
FIG. 3B is a sectional view showing a state of bringing an injection nozzle into contact with a stationary die (step of contacting injection nozzle and controlling contact force)

The pressure value of the working oil supplied to the hydraulic piston/cylinder unit 40 is set to the control apparatus and the set value is outputted from the control apparatus to the variable pressure control apparatus 50. Thereby, the injection nozzle N is brought into contact with the sprue hole 4 by a predetermined pressure to achieve a predetermined closeness. For example, when a thin-walled product having a wall thickness equal to or smaller than 2.0 mm, a product in which a ratio of a total length L of a product in a direction of flow of molten metal to a wall thickness t is specified as $L/t \geqq 100$ or the like is formed, there is achieved a closeness withstanding a maximum vacuum degree of 200 Torr and a maximum press value of 0.5 MPa which are preferably needed. FIG. 3B shows a state of bringing the injection nozzle N into press contact therewith in this way.

Figure 3C:
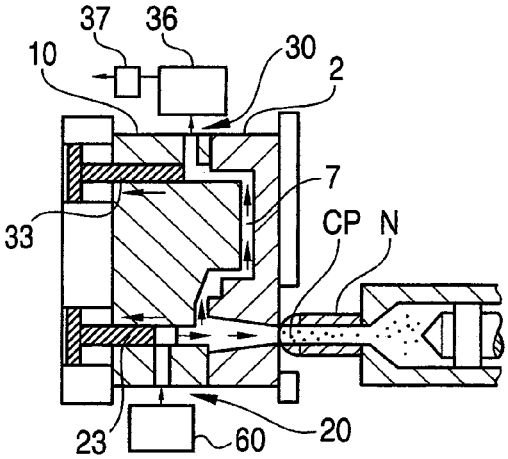
FIG. 3C is a sectional view showing a state of coating a lubricant (lubricant coating step)

As shown by FIG. 3C, the shaft pins 23, 33 are driven to the first escape positions by the first and second hydraulic piston/cylinder units 24, 34. Thereby, there is brought about a state of capable of coating the lubricant. The electromagnetic opening/closing valves 71, 74 of the lubricant supply apparatus 60 are opened. Then, high pressure gas is supplied from the compressed gas tank 62 to the spray nozzle 72. Further, the lubricant is supplied from the lubricant tank 63 to the spray nozzle 72. The lubricant becomes mist by the spray nozzle 72 and is pressurized from the lubricant supply path 20 to the cold plug catcher, the sprue hole 4, the runner groove 5, the gate hole 6, the cavity 7 and the like. At this occasion, an inner gas of the cavity 7 and the like are exhausted into the atmosphere via the mist separator 37 by the air sucking apparatus 36. The lubricant in the form of mist is adhered to surfaces of the cold plug catcher 13, the sprue hole 4, the runner groove 5, the cavity 7, the exhaust hole 8 and the like by passing the hose 25, the second supply path 22, the first supply path 21. The lubricant is finished to be coated by coating the lubricant by a predetermined amount or a predetermined period of time. When the lubricant is coated in this way, the pressure applied to the lubricant tank 63 and the pressure of the compressed gas tank 62 are controlled by the variable pressure control apparatus 68, 67. That is, the pressures are operated by the operation apparatus 64 such that a pressure difference between the pressure applied to the lubricant and the inner pressure of the cavity 7 and a pressure difference between the pressure of the compressed gas and the inner pressure of the cavity 7 become constant, and outputted to the variable pressure control apparatus 68, 67. Thereby, a flow rate of mist becomes constant.

The metal raw material is measured by the injection unit SU. FIG. 3C shows a state in which the dies are fastened as described above, the cold plug CP is formed at the front end portion of the injection nozzle N, a predetermined amount of a molten metal material YK is measured by a measuring chamber of the heating cylinder C.

Figure 3D:
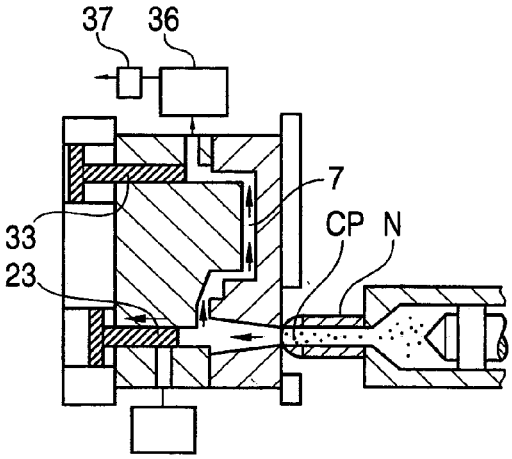
FIG. 3D is a sectional view showing a state of capable of carrying out injection (step of shutting off lubricant path and decompressing)
Figure 3E:
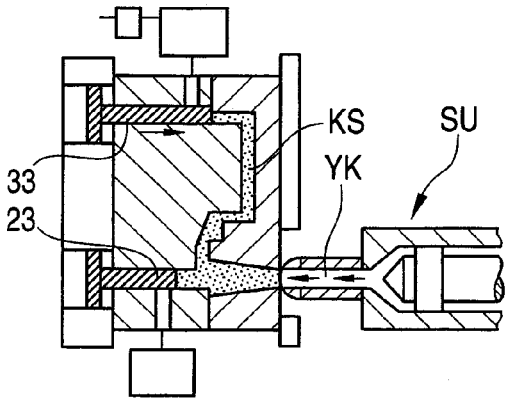
FIG. 3E is a sectional view showing a state of finishing injection and filling (step of shutting off lubricant exhaust path and injection pressure holding and cooling)

The shut off pin 23 is driven to the second position of closing the lubricant supply path 20 by the first hydraulic piston/cylinder unit 24. The air sucking apparatus 36 is continued to be operated. Thereby, inside of the cavity 7 and the like are decompressed. The inside of the cavity 7 and the like are decompressed by a constant period of time or until the pressure at the inside of the cavity 7 becomes the set pressure. FIG. 3D shows the decompressed state. After having been decompressed, the shut off pin 33 is driven to the second position at which the front end portion reaches the bottom portion of the exhaust hole 8 by the second hydraulic piston/cylinder unit 34. Thereby, the first supply path 21 and the first exhaust path 31 are closed to bring about a state of capable of injecting the metal raw material. The state is shown by FIG. 3E.

Figure 3F:
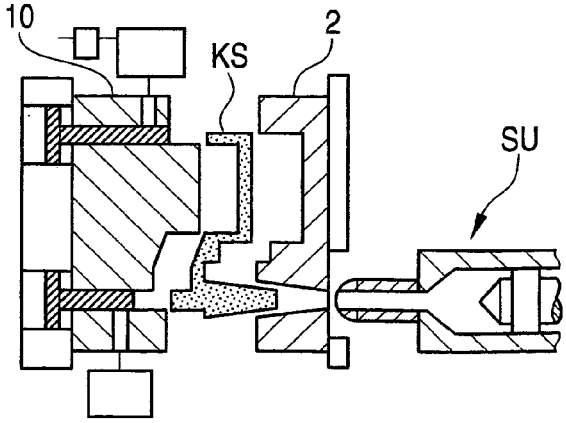
FIG. 3F is a sectional view showing a state of taking out a metal mold (step of moving back nozzles opening dies and projecting product).

The measured molten metal material YK is injected by driving the screw S of the injection unit SU in the axial direction. The cold plug CP is received by the cold plug catcher 13, and the molten metal material YK is filled in the cavity 7 by passing the sprue hole 4, the runner groove 5, and the gate hole 6. The extra molten metal material YK reaches the exhaust hole 8. Also a state of finishing to fill the molten metal material YK is shown by FIG. 3E. A pressure holding step is carried out as in the related method. When a time period of cooling and solidifying the filled molten metal material YK has elapsed, or when measurement has been finished by driving to rotate the screw after injection and pressure holding, the movable die 10 is opened. The ejector pins are projected from the movable die 10, and a metal mold KS is projected along with the sprue, the runner, an overflow or the like. A state of taking out the metal mold KS is shown by FIG. 3F.

When the metal mold is taken out, the shut off pins 23, 33 are driven to the first escape positions by the first and second hydraulic piston/cylinder units 24, 34. Then, the cavity 7 and the like are decompressed and the lubricant is coated by a predetermined period of time as described above. Thereby, preparation for shifting to the successive molding cycle is finished. In the following, molding is carried out similarly.

The invention can be embodied in various forms without being limited by the above-described embodiment. For example, although an explanation has been given such that when the lubricant in the mist form is pressurized, the cavity 7 and the like are decompressed by the air sucking apparatus 36, the invention can also be embodied such that an opening/closing valve is simply provided in place of the air sucking apparatus 36, when the lubricant is coated, by opening the opening/closing valve, the inner air of the cavity 7 and the like is exhausted by the pressurized lubricant in the mist form. Further, although an explanation has been given such that the lubricant is supplied or coated while decompressing the cavity and the like, it is also possible that after coating the lubricant by decompressing the cavity 7 and the like to some degree, the exhaust path 30 is closed and the lubricant is coated to corners of the cavity and the like again by a high pressure. Further, although an explanation has been given such that the lubricant is formed into mist by air, it is apparent that an inert gas is applicable in order to prevent the molten metal from being oxidized. With regard to the apparatus of the dies for the metallic mold, the apparatus can also be embodied by providing the lubricant supply path 20 or the exhaust path 30 on the side of the stationary die 2. Further, it is apparent that the embodiment can be embodied similarly also by an injection nozzle of a type of being provided with a shut off valve. Further, it is apparent that the embodiment can be embodied similarly even by hot chamber type diecasting in place of the injection unit SU. The first and the second hydraulic piston/cylinder units 24, 34 can be embodied even by air pressure in place of hydraulic pressure. Further, it is apparent that valve mechanisms for opening and closing the first supply path 21 and the first exhaust path 31 are not limited to the shut off pins 23, 24. Although according to the embodiment shown in FIG. 1, the injection unit SU is driven by the hydraulic piston/cylinder unit 40, the invention can be embodied also by a servo electric motor. The contact force of the injection nozzle in this case is controlled by a current value. Further, it is also apparent that it is also possible that a member for driving the injection unit SU is interposed with a pressure meter or a strain meter and the contact force or the press force can be controlled such that the instruments show a predetermined value.

What is claimed is:

1. A method of coating a lubricant in a metallic injection molding machine comprising a die comprising a stationary die and a movable die, a cavity formed on parting faces of at least one of the stationary die and the movable die, a sprue hole, a runner groove, and a gate hole, a molten metal being injected from an injection nozzle via a filling hole of the sprue hole, the runner groove, and the gate hole to fill the cavity for providing a metallic mold, the method comprising:

fastening the movable die to the stationary die;

press contacting the injection nozzle with an injection hole of the stationary die by a predetermined contact force of the injection nozzle to the injection hole of the stationary die which achieves a predetermined closeness thereof; and coating the lubricant to faces of the filling hole and the cavity of the die by a predetermined pressure before injecting the molten metal, wherein the predetermined contact force is set in advance by:

fastening the movable die to the stationary die and making the parting faces substantially airtight;

bringing the injection nozzle into close contact with the injection hole; and investigating a relationship between a contact force of the injection nozzle to the injection hole and inner pressure of the cavity when air is leaked by at least one of supplying compressed air to the cavity, decompressing the cavity and changing the contact force.

2. The method of coating a lubricant in a metallic injection molding machine according to claim 1, wherein in the coating, one end portion of the cavity is opened or air is exhausted therefrom, and the lubricant is coated from another end portion.

3. The method of coating a lubricant in a metallic injection molding machine according to claim 1, wherein in the coating, one end portion of the cavity is opened or air is exhausted therefrom, and the lubricant is coated from another end portion after the press contacting, and wherein thereafter, the one end portion of the cavity is closed or air is stopped from being exhausted therefrom, and the lubricant is coated again until an inner pressure of the cavity becomes a predetermined pressure.

4. The method of coating a lubricant in a metallic injection molding machine according to claim 1, wherein after the coating, an inner pressure of the cavity is decompressed until the inner pressure becomes a predetermined pressure.

5. The method of coating a lubricant in a metallic injection molding machine according claim 1, wherein the lubricant is coated as a mist by being mixed with a compressed gas.

6. The method of coating a lubricant in a metallic injection molding machine according to claim 5, Wherein a pressure applied to the lubricant to be mixed and a pressure of the compressed gas to be mixed are controlled so as to coat the lubricant while maintaining constant:

a pressure difference between the pressure applied to the lubricant to be mixed and an inner pressure of the cavity; and a pressure difference between the pressure of the compressed gas to be mixed and the inner pressure of the cavity.

7. The method of coating a lubricant in a metallic injection molding machine according to claim 1, wherein the coating the lubricant comprises using a predetermined amount of the lubricant.

8. The method of coating a lubricant in a metallic injection molding machine according to claim 1, wherein the coating the lubricant comprises coating for a predetermined period of time.

9. The method of coating a lubricant in a metallic injection molding machine according to claim 5, wherein a pressure applied to the lubricant to be mixed and a pressure of the compressed gas to be mixed are controlled.

10. The method of coating a lubricant in a metallic injection molding machine according to claim 5, wherein a flow rate of the mist becomes constant.

11. The method of coating a lubricant in a metallic injection molding machine according to claim 5, wherein a flow rate of the mist is constant.

12. The method of coating a lubricant in a metallic injection molding machine according to claim 6, wherein a flow rate of the mist becomes constant.

13. The method of coating a lubricant in a metallic injection molding machine according to claim 6, wherein a flow rate of the mist is constant.

14. The method of coating a lubricant in a metallic injection molding machine according to claim 9, wherein a flow rate of the mist becomes constant.

15. The method of coating a lubricant in a metallic injection molding machine according to claim 9, wherein a flow rate of the mist is constant.

16. A method of coating a lubricant in a metallic injection molding machine comprising a die comprising a stationary die and a movable die, a cavity formed on parting faces of at least one of the stationary die and the movable die, a sprue hole, a runner groove, and a gate hole, a molten metal being injected from an injection nozzle via a filling hole of the sprue hole, the runner groove, and the gate hole to fill the cavity for providing a metallic mold, the method comprising:

fastening the movable die to the stationary die;

press contacting the injection nozzle with an injection hole of the stationary die by a contact force to achieve a predetermined closeness based on a relationship between a contact force of the injection nozzle to the injection hole of the stationary die and a closeness thereof; and, coating the lubricant to faces of the filling hole and the cavity of the die by a predetermined pressure before injecting the molten metal;

wherein the lubricant is coated as a mist by being mixed with a compressed gas; and a pressure applied to the lubricant to be mixed and a pressure of the compressed gas to be mixed are controlled so as to coat the lubricant while maintaining constant a pressure difference between the pressure applied to the lubricant to be mixed and an inner pressure of the cavity; and a pressure difference between the pressure of the compressed gas to be mixed and the inner pressure of the cavity.

* * * * *